US005477569A

United States Patent [19]

Porter

[11] Patent Number: 5,477,569

[45] Date of Patent: Dec. 26, 1995

[54] PORTABLE TOILET

[76] Inventor: Helen G. Porter, Box 81 Duchess, Alberta, Canada, T0J0Z0

[21] Appl. No.: 375,586

[22] Filed: Jan. 19, 1995

[51] Int. Cl.[6] ..... A47K 11/06

[52] U.S. Cl. ..... 4/483; 4/254; 4/DIG. 5; 220/343

[58] Field of Search ..... 4/242.1, 254, 450, 4/454, 457, 462, 478, 479, 483, DIG. 5; 220/335, 343

[56] References Cited

U.S. PATENT DOCUMENTS

| | | | |
|---|---|---|---|
| 692,448 | 2/1902 | Jones | 220/335 |
| 1,181,162 | 5/1916 | Pierce | 4/483 |
| 1,297,813 | 3/1919 | Ena | 4/450 |
| 1,632,021 | 6/1927 | Breaux | 4/450 |
| 2,529,248 | 11/1950 | Fleck | 220/263 |
| 2,739,729 | 3/1956 | Jonas | 220/335 X |
| 2,988,752 | 6/1961 | Wyne | 4/483 X |
| 4,558,799 | 12/1985 | Hammond | 220/343 |

FOREIGN PATENT DOCUMENTS

| | | | |
|---|---|---|---|
| 0127754 | 2/1948 | Australia | 4/483 |

*Primary Examiner*—Robert M. Fetsuga

[57] ABSTRACT

A portable toilet including a container of a generally pear-shaped cross-section having a rear component and a front component, the container further having a planar bottom wall with a concave back edge, a concave front edge, and a pair of curved intermediate side edges therebetween and with the back edge having a radius of curvature greater than that of the front edge, the container additionally having a peripheral side wall including a lower extent and an upper extent with the lower extent integral with and projected upwardly from the periphery of the bottom wall to define a central opening having a rear portion and a front portion and with the upper extent flared outwards and then downwards to define a seat having a concave back part, a concave front part, and a pair of curved intermediate parts therebetween; and a cover mechanism removably securable over the central opening.

3 Claims, 3 Drawing Sheets

5
10
50
60
70
5
72
3
14
76
16
3

62

74
52
12
80

PORTABLE TOILET

BACKGROUND OF THE INVENTION

1. Field of the Invention

The present invention relates to a portable toilet and more particularly pertains to providing a location where children may deposit urine and excrement in a sanitary fashion with a portable toilet.

2. Description of the Prior Art

The use of toilets is known in the prior art. More specifically, toilets heretofore devised and utilized for the purpose of providing a location for depositing human waste are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 328,126 to Wadsworth, Jr. discloses a portable toilet. U.S. Pat. No. 4,606,080 to Clenentino discloses a portable toilet. U.S. Pat. No. 4,807,308 to Person et al. discloses a portable stacking and desk toilet. U.S. Pat. No. 5,088,134 to Douglas discloses a portable non-flushing toilet. U.S. Pat. No. 5,095,556 to Franey discloses a portable personal commode. U.S. Pat. No. 5,251,342 to Sansom et al. discloses a plastic portable toilet assembly.

While these devices fulfill their respective, particular objective and requirements, the aforementioned patents do not describe a portable toilet that is simple in design and is readily transportable from one location to another.

In this respect, the portable toilet according to the present invention substantially departs from the conventional concepts and designs of the prior art, and in doing so provides an apparatus primarily developed for the purpose of providing a location where children may deposit urine and excrement in a sanitary fashion.

Therefore, it can be appreciated that there exists a continuing need for new and improved portable toilet which can be used for providing a location where children may deposit urine and excrement in a sanitary fashion. In this regard, the present invention substantially fulfills this need.

SUMMARY OF THE INVENTION

In the view of the foregoing disadvantages inherent in the known types of toilets now present in the prior art, the present invention provides an improved portable toilet. As such, the general purpose of the present invention, which will be described subsequently in greater detail, is to provide a new and improved portable toilet and method which has all the advantages of the prior art and none of the disadvantages.

To attain this, the present invention essentially, in combination, a rigid plastic container of a generally pear-shaped cross-section including a rear component and front component. The container also includes a planar bottom wall with a concave back edge, a concave front edge, and a pair of curved intermediate side edges therebetween and with the back edge having a radius of curvature greater than that of the front edge. The container additionally includes a peripheral side wall having a lower extent and an upper extent. The lower extent of the sidewall is integral with and projected upwardly from the periphery of the bottom wall to define a central opening. The central opening has a rear portion and a front portion. The upper extent of the sidewall is flared outwards and then downwards to define a seat having a concave back part, a concave front part, and a pair of curved intermediate parts therebetween.

A rigid planar plastic back lid is included and hingably coupled to the back part of the seat. The back lid is positionable over the rear portion of the central opening of the container. The back lid has a periphery formed of a concave rear edge, a straight front edge, and a lip integral with and projected downwardly from the rear edge and with the lip snapidly securable to the back part of the seat. The back lid is further positionable in a upward orientation with respect to the seat to operate as a seat back.

A rigid planar plastic front lid is also provided and hingably coupled to the front part of the seat. The lid is positionable over the front portion of the central opening of the container. The front lid has a periphery formed of a concave front edge, a straight rear edge, a pair of opposed convex intermediate side edges extended therebetween, and a lip integral with and projected downwardly from the rear edge and intermediate edges. The lip is snapidly securable to the front part and intermediate parts of the seat. The front lid is further positionable in an upward orientation with respect to the seat to operate as a splash guard. Lastly, a plastic handle integral with the rear component of the container is included and extended outwardly therefrom for allowing a user a firm grip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable toilet which has all the advantages of the prior art toilets and none of the disadvantages.

It is another object of the present invention to provide a new and improved portable toilet which may be easily and efficiently manufactured and marketed.

It is a further object of the present invention to provide a new and improved portable toilet which is of durable and reliable construction.

An even further object of the present invention is to provide a new and improved portable toilet which is susceptible of a low cost of manufacture with regard to both materials and labor, and which accordingly is then susceptible of low prices of sale to the consuming public, thereby making such a portable toilet economically available to the buying public.

Still yet another object of the present invention is to provide a new and improved portable toilet which provides in the apparatuses and methods of the prior art some of the advantages thereof, while simultaneously overcoming some of the disadvantages normally associated therewith.

Even still another object of the present invention is to provide a new and improved portable toilet for providing a location where children may deposit urine and excrement in a sanitary fashion.

Lastly, it is an object of the present invention to provide a new and improved portable toilet comprising a container of a generally pear-shaped cross-section including a rear component and front component, the container including a planar bottom wall with a concave back edge, a concave front edge, and a pair of curved intermediate side edges therebetween and with the back edge having a radius of curvature greater than that of the front edge, the container further including a peripheral side wall having a lower extent and an upper extent with the lower extent integral with and projected upwardly from the periphery of the bottom wall to define a central opening having a rear portion and a front portion and with the upper extent flared outwards and then downwards to define a seat having a concave back part, a concave front part, and a pair of curved intermediate parts therebetween; and a cover mechanism removably securable over the central opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
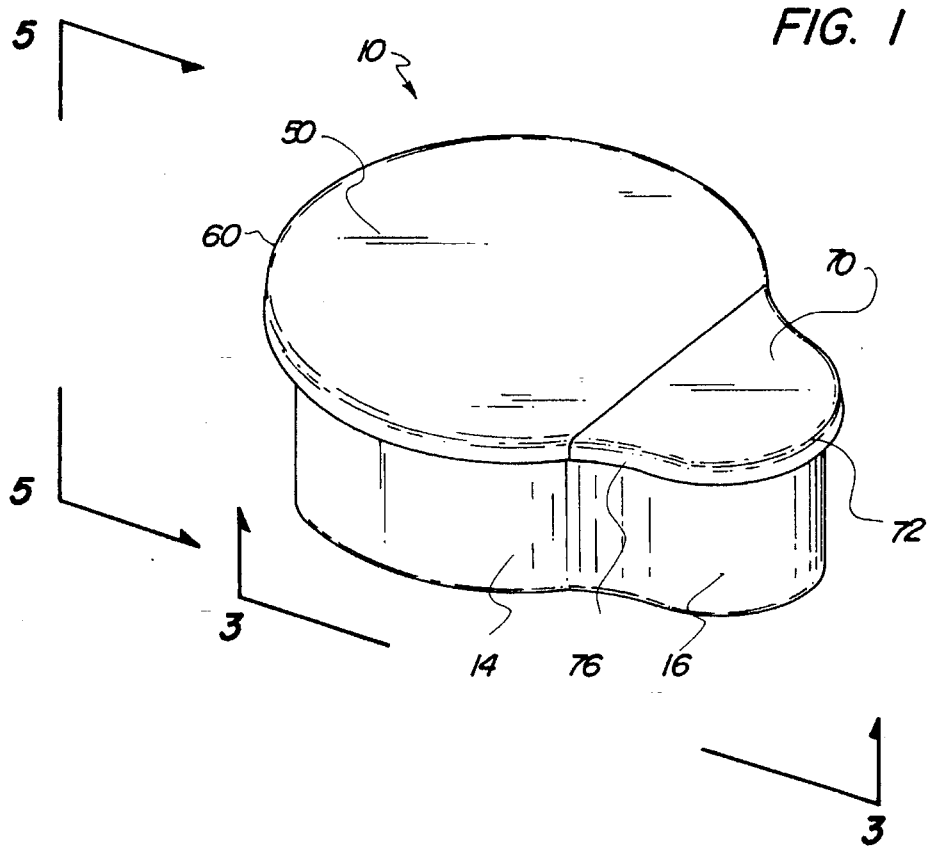
FIG. 1 is a perspective view of the preferred embodiment of the portable toilet constructed in accordance with the principles of the present invention.

With reference now to the drawings, and in particular, to FIG. 1 thereof, the preferred embodiment of the new and improved portable toilet embodying the principles and concepts of the present invention and generally designated by the reference number 10 will be described.

The present invention is comprised of a plurality of components. In their broadest context, such components include a container, lids, and handle. Such components are individually configured and correlated with respect to each other to provide the intended function of providing a portable location where children may deposit urine and excrement in a sanitary fashion.

Figure 3:
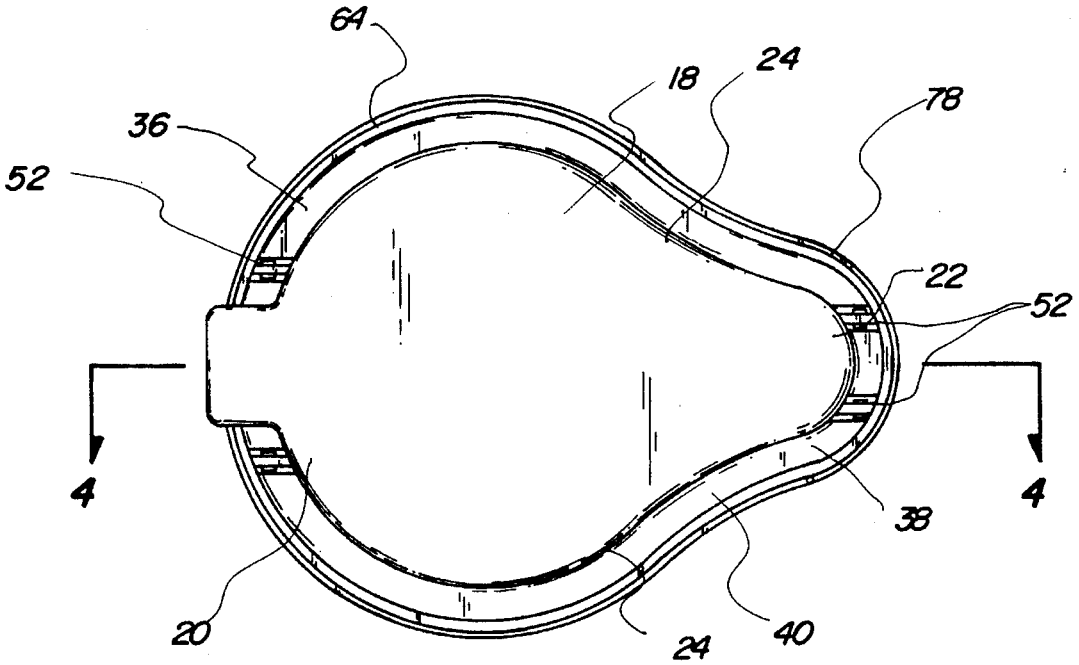
FIG. 3 is a view of the present invention taken along the line 3—3 of FIG. 1.

Specifically, the present invention includes a container 12. The container is formed of a rigid plastic material. The container has a generally pear-shaped cross-section as shown in FIG. 3. This cross section is formed of a rear component 14 and a front component 16 as shown in FIG. 1. The rear component 14 has a central axis defined therethrough, and the front component has a central axis defined therethrough. The container also includes a planar bottom wall 18 as best illustrated in FIG. 3. The bottom wall has a concave back edge 20, a concave front edge 22, and a pair of curved intermediate side edges 24 therebetween. The back edge has a radius of curvature greater than that of the front edge. In the preferred embodiment, the radius of curvature as measured from the central axis of the front component to the front edge of the bottom wall is about 2.10 inches. Furthermore, the radius of curvature as measured from the central axis of the rear component to the rear edge of the back wall is about 3.25 inches.

Figure 4:
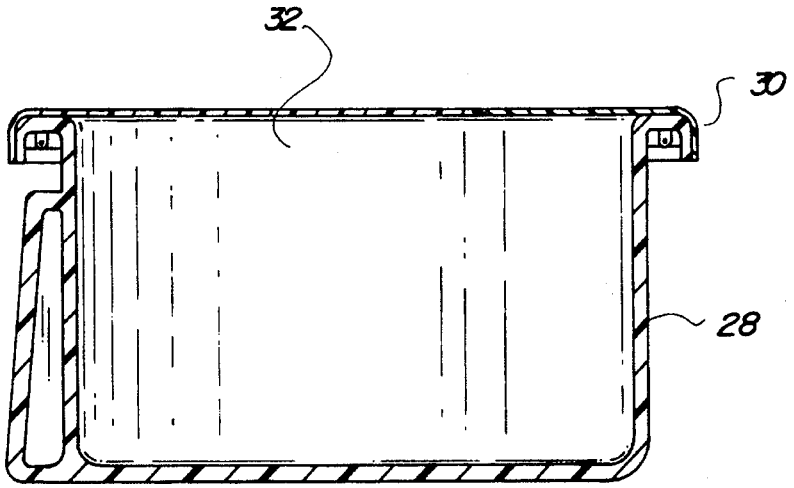
FIG. 4 is a cross-sectional view of the present invention taken along the line 4—4 of FIG. 3.
Figure 5:
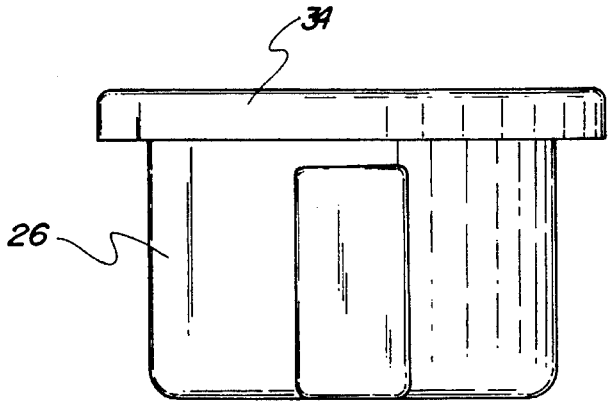
FIG. 5 is a view of the present invention taken along the line 5—5 of FIG. 1.

The container additionally includes a peripheral sidewall 26. The sidewall has a lower extent 28 and an upper extent 30 as best illustrated in FIG. 4. The lower extent is integral with and projected upwardly from the periphery of the bottom wall 18 to define a hollow interior and a central opening 32 for allowing access to the interior. The central opening further has a rear portion aligned with the rear component and a front portion aligned with the front component. The upper extent of the side wall is flared outwards and then downwards to define a seat 34 as shown in FIG. 5. The seat has a back part 36, a concave front part 38, and a pair of curved intermediate parts 40 therebetween as shown in FIG. 3. In the preferred embodiment, the container has a depth of 4.50 inches as measured from the seat to the bottom wall. The seat extends outwardly from the side wall a distance of about 0.75 inches. Furthermore, the radius of curvature as measured from the central axis of the rear component to the outer extent of the back part of the seat is about 4.00 inches. In addition, the radius of curvature as measured from the central axis of the front component to the outer extent of the front edge of the seat is about 3.00 inches.

Figure 2:
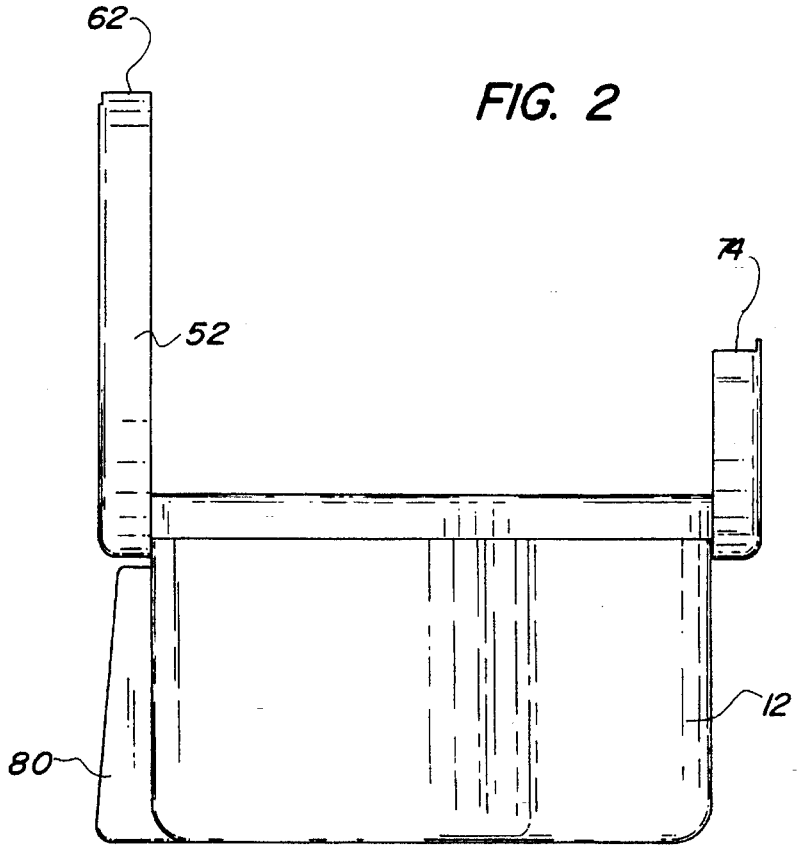
FIG. 2 is a side elevational view of the preferred embodiment of the present invention with the back lid opened to act as a seat back and the front lid opened to act as a splash guard.

Also provided is a back lid 50. The back lid is generally planar in structure and formed of a rigid plastic material. The back lid is coupled to the back part 36 of the seat with a pair of spaced hinges 52. Each hinge is formed with a pair of eyelets 54 integral with the lid, a tongue 56 integral with the seat, and a peg 58 securable through the tongue and eyelets. The back lid is positionable over the rear portion of the central opening of the container. The back lid has a periphery formed of a concave rear edge 60, a straight front edge 62, and a lip 64 integral with and projected downwardly from the rear edge as shown in FIG. 3. The lip is snapidly securable to the back part 36 of the seat to thereby seal the rear portion of the central opening and prevent inadvertent leakage. The back lid is further positionable in an upward orientation with respect to the seat to operate as a seat back as shown in FIG. 2.

Figure 6:
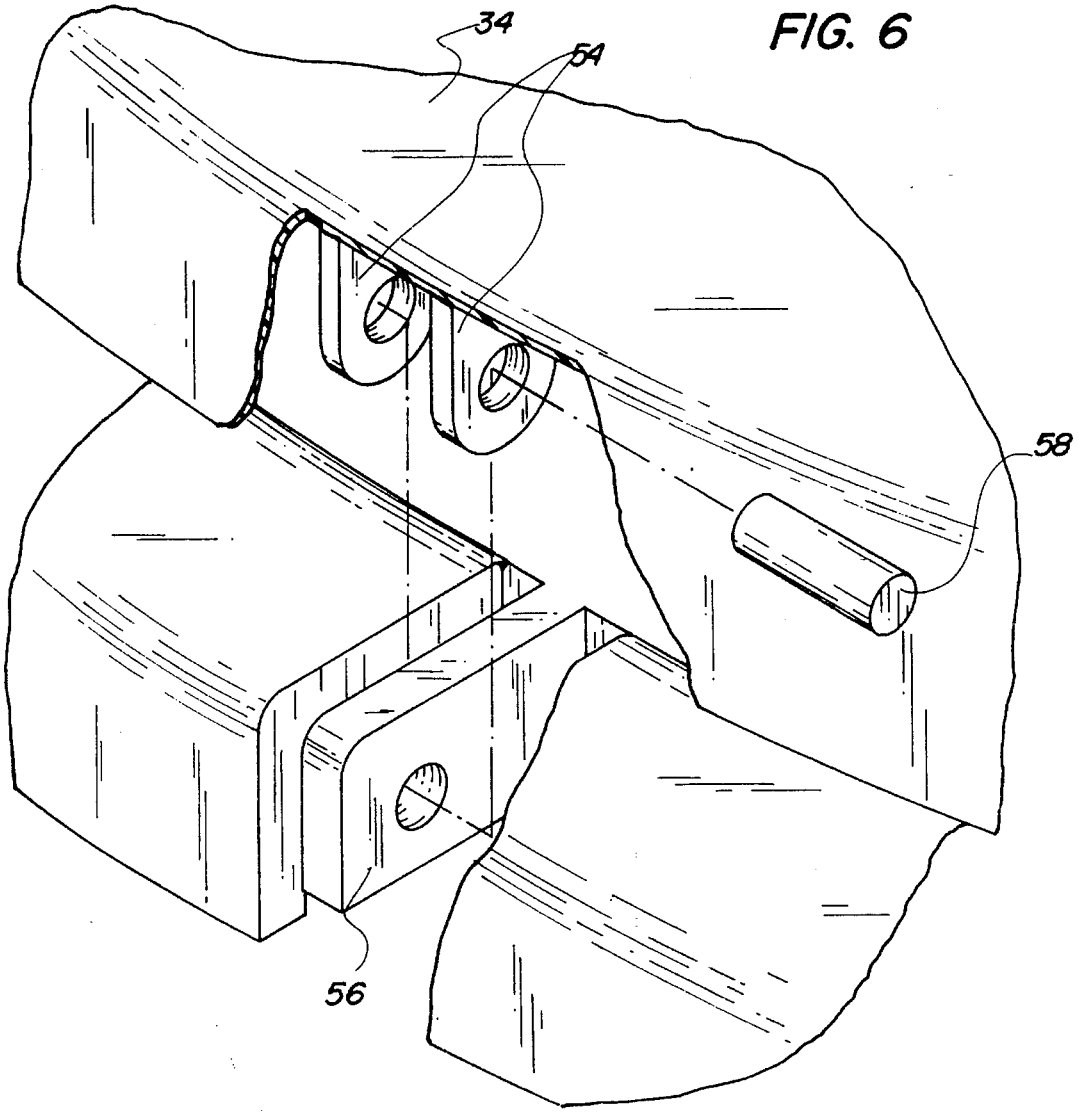
FIG. 6 is an enlarged perspective fragmentary view of the hingable coupling of the back lid to the seat.

In addition, a front lid 70 is provided. The front lid is generally planar in structure and formed of a rigid plastic material. The front lid is coupled to the front part of the seat with a pair of hinges 52. The hinges are structured similarly to the hinges used for coupling the back lid as previously shown in FIG. 6. The front lid is positionable over the front portion of the central opening of the container. The lid has a periphery formed of a concave front edge 72, a straight rear edge 74, and a pair of opposed convex intermediate side edges 76 extended therebetween as best illustrated in FIG. 1. Furthermore, a lip 78 is included and projected downwardly from the rear edge and intermediate edges as best illustrated in FIG. 3. The lip is snapidly securable to the front part 38 and intermediate parts 40 of the seat to thereby seal the front portion of the central opening and prevent inadvertent leakage. The front lid is also positionable in an upward orientation with respect to the seat to operate as a urine splash-guard as shown in FIG. 2. The straight rear edge 74 of the front lid and the straight back edge 62 of the back lid form a seal therebetween when closed over the central opening to thus preclude leakage from the container.

Lastly, a plastic handle 80 is provided. The plastic handle is integral with the rear component 14 of the container as shown in FIG. 2. The handle is extended outwardly from the rear component for allowing a user a firm grip. In the preferred embodiment, the lower extent of the handle near the bottom wall is projected outwards from the sidewall 26 about 1.50 inches.

The present invention is especially useful for providing a portable sanitation receptacle for children when traveling or as an emergency waste receptacle when no other facilities are nearby for use. To operate the present invention, both lids are lifted for allowing access to the hollow interior for the deposition of waste. After waste has been deposited within the container, the lids are closed to thereby seal the waste therein for subsequent disposal at a later time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A portable toilet for children comprising, in combination:

a rigid container of a generally pear-shaped cross-section including a rear component and front component, the container further including a planar bottom wall with a concave back edge, a concave front edge, and a pair of curved intermediate side edges therebetween and with the back edge having a radius of curvature greater than that of the front edge, the container additionally including a peripheral side wall having a lower extent and an upper extent with the lower extent integral with and projected upwardly from the periphery of the bottom wall to define a central opening having a rear portion and a front portion and with the upper extent flared outwards and then downwards to define a seat having a concave back part, a concave front part, and a pair of curved intermediate parts therebetween;

a rigid planar back lid hingably coupled to the back part of the seat and positionable over the rear portion of the central opening of the container, the back lid having a periphery formed of a concave rear edge, a straight front edge, and a lip integral with and projected downwardly from the rear edge and with the lip snapidly securable to the back part of the seat, the back lid further positionable in a upward orientation with respect to the seat to operate as a seat back; and a rigid planar front lid hingably coupled to the front part of the seat and positionable over the front portion of the central opening of the container, the front lid having a periphery formed of a concave front edge, a straight rear edge, a pair of opposed convex intermediate side edges extended therebetween, and a lip integral with and projected downwardly from the rear edge and intermediate edges and with the lip snapidly securable to the front part and intermediate parts of the seat, the front lid further positionable in an upward orientation with respect to the seat to operate as a splash guard.

2. The portable toilet as set forth in claim 1 further including a handle coupled to the rear component of the container for allowing the user a firm grip.

3. The portable toilet as set forth in claim 1 wherein the container and cover mechanism are formed of plastic.

* * * * *